US006109465A

United States Patent [19]

Henning

[11] Patent Number: 6,109,465

[45] **Date of Patent: *Aug. 29, 2000**

[54] TAMPER-EVIDENT CLOSURE SYSTEM

[75] Inventor: John C. Henning, Fairfield, Ohio

[73] Assignee: Product Investment Inc., Cincinnati, Ohio

[ * ] Notice: This patent is subject to a terminal disclaimer.

[21] Appl. No.: 09/152,953

[22] Filed: Sep. 14, 1998

Related U.S. Application Data

[62] Division of application No. 08/697,426, Aug. 23, 1996, Pat. No. 5,806,700, which is a continuation of application No. 08/398,430, Mar. 6, 1995, abandoned.

[51] Int. Cl.[7] ..... B65D 41/12

[52] U.S. Cl. ..... 215/328; 215/43; 215/295; 215/901

[58] Field of Search ..... 215/40, 43–46, 215/295, 324, 326–329, 341, 342, 318, 321

[56] References Cited

U.S. PATENT DOCUMENTS

| | | | |
|---|---|---|---|
| Re. 36,334 | 10/1999 | Henning | 215/328 |
| 856,400 | 6/1907 | Gillette . | |
| 864,697 | 8/1907 | Schmitt . | |
| 1,673,485 | 6/1928 | Berge | 215/250 |
| 1,796,729 | 3/1931 | Sharp et al. . | |
| 2,014,033 | 9/1935 | Smith . | |
| 2,034,826 | 12/1936 | Jackson . | |
| 2,063,615 | 12/1936 | Merolle . | |
| 2,726,001 | 12/1955 | Cululi . | |
| 3,077,280 | 2/1963 | Foss et al. . | |
| 3,147,875 | 9/1964 | Rutledge, Sr. . | |
| 4,055,266 | 10/1977 | Amabili . | |
| 4,782,969 | 11/1988 | Henning | 215/328 X |
| 5,263,600 | 11/1993 | Henning | 215/328 |
| 5,806,700 | 9/1998 | Henning | 215/328 |

*Primary Examiner*—Stephen K. Cronin
*Assistant Examiner*—Robin Hylton
*Attorney, Agent, or Firm*—Wood, Herron & Evans LLP

[57] ABSTRACT

A tamper-proof closure construction including a cap having a top wall, a skirt and a plurality of tabs extending from the bottom edge of the skirt. The cap fits over the opening in the neck of a container which neck includes a shelf, cams having portions beneath the shelf extending outwardly from the neck beyond the shelf and all portions of the neck between the shelf and a sealing surface on the end of the neck.

25 Claims, 4 Drawing Sheets

TAMPER-EVIDENT CLOSURE SYSTEM

This is a divisional of U.S. patent application Ser. No. 08/697,426 filed Aug. 23, 1996, to be issued on Sep. 15, 1998, as U.S. Pat. No. 5,806,700, which is a file wrapper continuation of U.S. patent application Ser. No. 08/398,430, filed Mar. 6, 1995, and now abandoned.

BACKGROUND OF THE INVENTION

The present invention relates to a tamper-evident closure construction for use with bottles and other containers and is particularly directed to a container having a neck, or "finish", configured to receive a twist-off cap which when once removed will provide the user with a readily observable indication that the container has previously been opened. In the past, a number of closure constructions have been proposed, including caps and arms, to seal the tops of bottles in such a manner that once the cap has been removed it provides a visual indication that the container has been opened. Such closures have been designed with the intent of preventing the practice of removing the cap to permit the introduction of a contaminant into the container and subsequently replacing the cap so that a subsequent user unknowingly ingests the contaminant.

One approach to the construction of tamper-evident closures in the past has been to provide detents or other protrusions on the bottle which deform portions of a thin metal cap when the cap is rotated during removal. This approach is exemplified in Sharp U.S. Pat. Nos. 1,796,728 and 1,796,729. A second approach is shown in Amabili U.S. Pat. No. 4,055,266. The closure construction disclosed in this patent includes a twist-off cap having one or more flanges which are turned under a bead provided on the bottle. The cap includes a series of lines of weakening, along which the flange ruptures or separates when it is removed, to provide a visual indication that the cap has been removed. These prior art closure constructions have not been totally satisfactory for various reasons. For example, the caps of the type shown in the Sharp patents can be reapplied to the bottle and can be pressed inwardly to assume a shape sufficiently close to the original cap configuration so that some users would not realize that the cap had previously been removed. Other prior art closures are not compatible with high speed capping equipment or are too complex or cumbersome.

Another type of tamper-evident closure construction is shown in my earlier U.S. Pat. No. 4,782,969 for "Twist-Off Bottle Caps" and U.S. Pat. No. 5,263,600 for "Tamper-Evident Twist-Off Closure". The cap shown in U.S. Pat. No. 4,782,969 includes a flat top and ribbed skirt which carries along its lower edge a plurality of narrow tabs. When the cap is applied to the bottle, these tabs are bent upwardly and inwardly to engage surfaces formed on the neck of the container below an endwise lip. When the cap is in the sealed and locked position, the upwardly bent portions of the tabs are in compression and hold the cap tightly sealed against the end of the lip. The cap is removed by an initial twisting motion followed by a lifting motion. The bottle includes a plurality of ribs which cam the tabs outwardly as the cap is twisted. When the cap is lifted, the tabs are bent further outwardly by an upwardly and outwardly sloping surface of a lip on the bottle, the bending continues until the tabs are in a position to clear the lip of the bottle permitting the cap to be lifted free from the bottle. While this construction provides an effective tamper-proof seal, it is subject to the disadvantage that it requires a relatively high amount of torque to twist off the cap.

The cap shown in my U.S. Pat. No. 5,263,600 utilizes a cap including a flat top which extend from the center edge of the skirt are bent upwardly and inwardly to a depending ribbed skirt and a plurality of narrow tabs. The tabs engage a shelf formed on the bottle and hold the cap in position by compression in generally the same manner as in U.S. Pat. No. 4,782,969. The bottle further comprises a plurality of cams which cam the tabs outwardly to a position beyond the outer edge of the shelf. The free ends of the tabs in this position are not bent completely against the skirt or the cap but rather remain at a slight angle. The lip extends upwardly and outwardly from the shelf. As a result, the free ends of the tabs engage the lip so that the tabs are not free to be moved upwardly. Rather when the cap is lifted and twisted, the tabs must be cammed outwardly by the outwardly sloping surface on the bottle lip before the cap can be pulled completely free of the bottle. The tabs disclosed in this patent are of an asymmetrical configuration with a portion adjacent one edge of the tab being slightly longer than the other to reduce the amount of torque required to twist the cap. The cap shown in my patent, U.S. Pat. No. 5,263,600 like that shown in my earlier patent, U.S. Pat. No. 4,782.969 cannot be reapplied to the bottle in their original configuration without the use of some highly sophisticated and complicated mechanism. Despite its advantages, the closure construction shown in U.S. Pat. No. 5,263,600 does present a number of disadvantages in use which are overcome by the present invention.

SUMMARY OF THE INVENTION

The present invention is directed to a closure construction which is an improvement upon the closure construction shown in my U.S. Pat. No. 5,263,600 as well as my earlier U.S. Pat. No. 4,782,969. The present closure construction includes a cap having a circular top wall and a depending flange, or skirt. The depending flange or skirt carries a plurality of tabs which are formed along the lower edge of the skirt between spaced ribs which are formed in the skirt. Each of the tabs includes two side edges interconnected by a transverse outer, or free edge. In a preferred embodiment the outer edge is curved to facilitate its sliding engagement with a cooperating ledge of the bottle.

The closure construction also includes a bottle having a neck configured to cooperate with the cap. The neck has a central pouring opening surrounded by an annular sealing rim. The periphery of the neck includes an outwardly projecting generally cylindrical but slightly tapered portion having an inwardly extending or undercut ledge. The ledge is adapted to be engaged by the free ends of the tabs when the cap is placed over the bottle and the tabs are bent upwardly into contact with the ledge. In accordance with the present invention, the ledge slopes upwardly at a small angle, preferably less than 10° from its inner diameter to its outer diameter. The outermost portion of the ledge adjacent to the peripheral wall of the projection is slightly curved so that there is no sharp point at this junction.

The bottle forming the present closure system further comprises a plurality of cam surfaces disposed beneath the ledge. The cam surfaces include generally vertical cam walls which extend from a location adjacent to the inner diameter of the ledge to a position outwardly of the maximum diameter of the ledge. In accordance with the principles of the present invention, the bottle is configured such that the diameters of all portions of the bottle from the ledge to the sealing rim are less than the maximum diameter of the cams. The function of the cams is to cam the tabs outwardly as the cap is rotated so that the tabs are disengaged from the ledge and are bent close to the inner surface of the skirt wall of the cap.

In one embodiment, the bottle is further configured to provide a lower protuberance disposed beneath the ledge and having an upwardly and inwardly extending surface effective to assist in guiding the free end of the tabs upwardly into engagement with the ledge during the capping operation.

In use, when a cap is applied it is placed over the open end of the bottle with the skirt extending downwardly around the ledge. The free ends of the tabs are bent inwardly and upwardly to engage the ledge. The portions of the tab between the endwise transverse tab edges and the juncture of the tab with the skirt are placed in compression and are effective to hold the cap tightly against the sealing rim of the bottle. In order to remove the cap, it is first rotated to cause the tabs to be bent outwardly by the cams to a position in which the tabs are located outwardly of the ledge as well as any other portion of the bottle between the cams and the sealing rim. The cap is completely removed by simply lifting it with minimum force since no further deformation of the tabs or cap is required.

After the present cap has been removed from the bottle, it cannot be relocked in its original condition. More particularly, once removed, the cap can be placed over the end of the bottle with the skirt and tabs surrounding the ledge and cams. However, the cap has been distorted so that it has only a very loose fit, making it readily apparent to anyone the cap had previously been removed. The tabs cannot be bent inwardly to return them to their original locked position.

One advantage of the present invention is the extremely obvious indication provided that the cap had been removed. With caps of the type shown in my earlier U.S. patents, it is not possible to fully replace the caps by bending the tabs back into their original locked position without the use of extremely complicated equipment. Nevertheless, the tabs tended to snugly embrace the outer surface of the bottle with the cap placed back in position so that a particularly careless user might not notice that the cap had been removed. In contrast, once a cap of the present closure construction has been removed from a bottle, it remains relatively loose when it is reapplied so that a clear unmistakable notice is given that the cap had previously been removed.

Another advantage of the present closure construction is that once the cap has been rotated sufficiently to cam all of the tabs outwardly, it can be lifted without any appreciable amount of force. As a result of the low torque required to turn the cap and the negligible force required to lift it, the completely removal of the cap is extremely easy.

Another advantage of the present invention is that it is obvious even to those who are totally unfamiliar with the novel construction of the cap the steps to be followed in its removal. More particularly, in the preferred embodiment four cams are provided on the bottle. When the cap is rotated 90°, all of the tabs have been disengaged from the ledge. The cap is then only loosely supported on the bottle, making it obvious that it can be removed by simply lifting it. More particularly, as indicated previously, the relationship of the bottle and cap is such that the tabs are bent outwardly into close proximity with the depending skirt of the cap. Thus the free ends of the tab do not protrude inwardly into engagement with the lip or any portion of the bottle except for the four cams. The cap is relatively loose and can be lifted off without any resistance, making it apparent to the user that no further rotation is necessary to release the cap. All that is necessary is that it be pulled outwardly. This is in contrast to a cap of the type disclosed in my earlier U.S. Pat. Ser. No. 5,263,600 in which once the tabs have been cammed outwardly, they were still disposed at a small angle to the skirt with the result that the free edge of the tabs engaged the outwardly extending bottle lip. There continues to be a perceptible resistance to movement either by rotation or by lifting. Under the circumstances, many users unfamiliar with the cap thought it necessary to continue rotating the cap as one would with a conventional screw-on cap design. This of course did not totally free the cap which required a lifting motion. The present closure construction eliminates this uncertainty as to the mode of removal of the cap.

A still further advantage of the present closure construction is the increased protection against blow-off of the cap in the event that the pressure within the bottle rises substantially. In the past, one problem with many cap designs is that if the pressure of the bottle contents rises substantially due, for example, to agitation or heating, the cap is blown from the end of the bottle like a projectile. This can present a dangerous situation for the user or bystanders. In contrast, the present cap, when subjected to pressure substantially above the pressure designed to be held, will remain attached to the bottle but will be lifted slightly from the sealing surface of the bottle to permit built up gases to escape. This safety action results from the fact that while the tabs are sufficiently rigid to remain substantially planar when the cap is subjected to the designed maximum pressure, if that pressure is substantially exceeded, the tabs will bow slightly while remaining trapped beneath the ledge. This allows the top surface of the cap to rise, leaving a small space between the under surface of the cap top and the sealing edge of the bottle to permit the venting of pressurized gases.

DETAILED DESCRIPTION OF THE DRAWINGS

The present closure system comprises two principal components, a cap 10 and a bottle 11 as shown in FIGS. 3–7.

Figure 1:
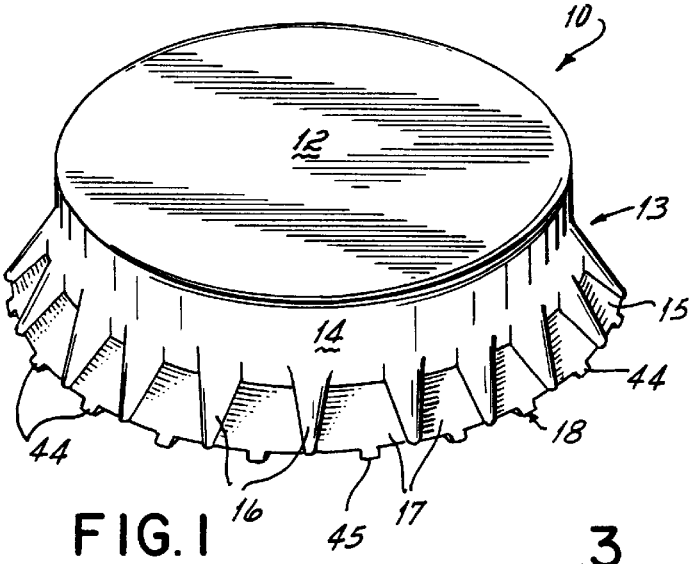
FIG. 1 is a perspective view of a cap for use in the present closure system, showing the condition of the cap prior to its application to the bottle top.
Figure 3:
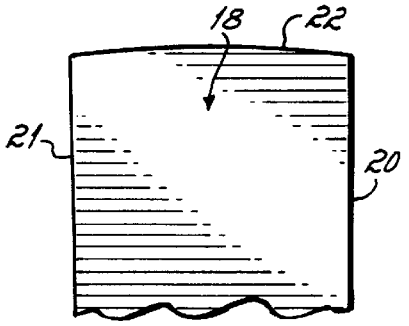
FIG. 3 is an enlarged elevational view of the encircled area 3 of FIG. 2 illustrating one form of locking tab.

As shown in FIG. 1, cap 10 comprises a generally circular top wall 12 having a depending peripheral flange or skirt 13. Skirt 13 includes a vertical wall portion 14 and a flared lower portion 15. A plurality of ribs 16 are formed in the lower portion of vertical wall 14 and flared section 15. Ribs 16 are preferably of generally U-shaped configuration and are spaced from one another. A plurality of webs 17 interconnect ribs 16.

A plurality of tabs 18 extend downwardly from the lower edge of the cap. Each tab is preferably positioned in the central portion of a web 17 intermediate two spaced ribs 16. Each of the tabs (See FIG. 3) is an elongate flat member having substantially parallel side edges 20 and 21. In the preferred embodiment, these edges are not perfectly parallel but rather taper outwardly slightly from a tab with an approximately 0.100 inch adjacent to the skirt to a width of 0.110 inch at the free edge of the tab to prevent the caps from interlocking with each other when bulk packed or hopper fed. The free or outer transverse edge 22 of the tab 18 is preferably curved so as to provide a convex surface. It is to be understood that while in the embodiment shown, tabs 18 are of symmetrical configuration, the tabs could also be of asymmetrical configuration as shown in my Pat. No. 5,263,600. A tab of this latter configuration is longer adjacent to one side edge than the other. The longer section preferably terminates in a curved bump or contact section. Again, while the preferred form of cap shown in FIG. 1 comprises twenty-one tabs, it is to be understood that a lesser or greater number of tabs can be provided. However, when the cap is to be used with a bottle such as bottle 11 having four ramps, it is advantageous to utilize an odd number of tabs. Such an odd number of tabs functions to reduce the twist-off torque required to remove the cap since a maximum torque condition exists if an excessive number of tabs are located at exactly the same position on each of the cams. This is precluded by providing an odd number of tabs for use in conjunction with an even number of ramps.

Figure 2:
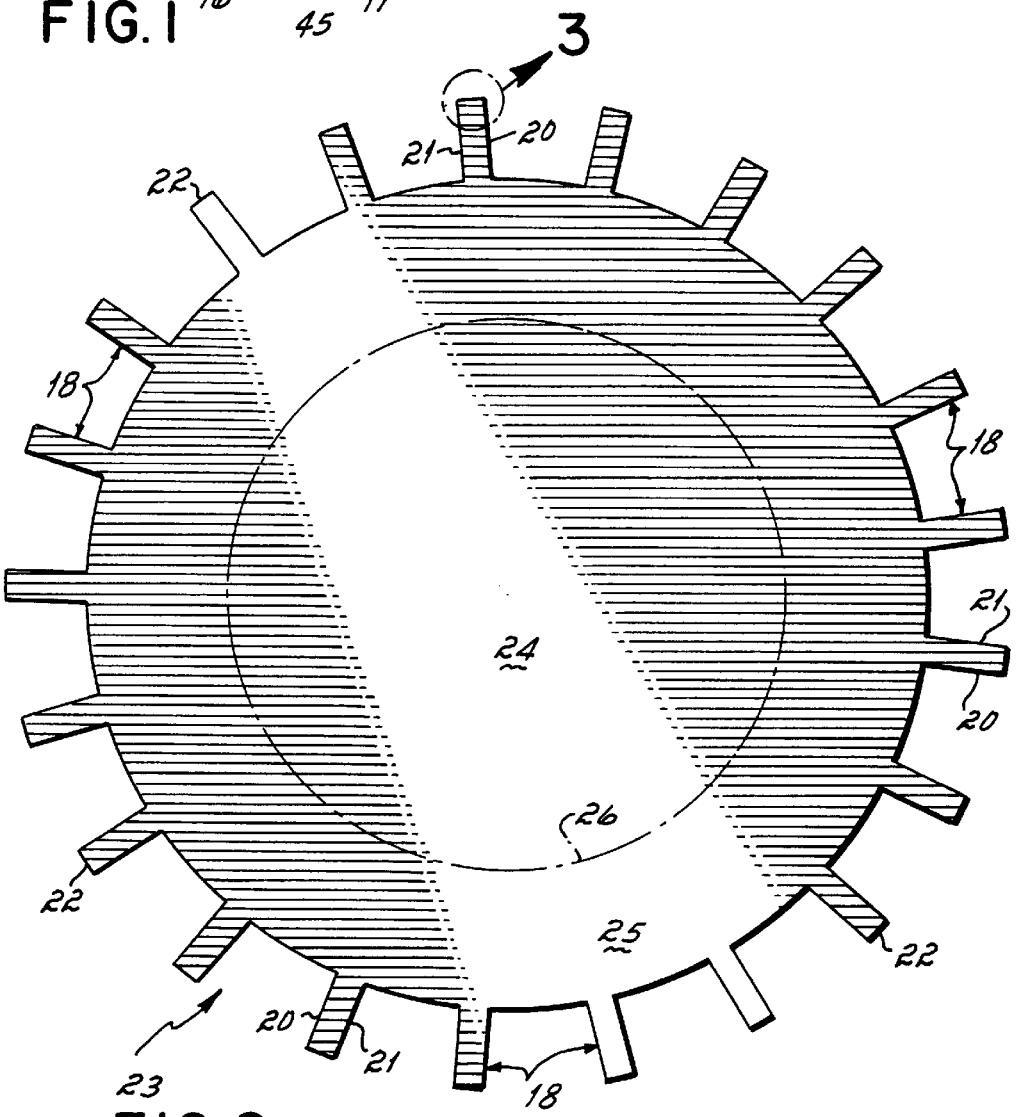
FIG. 2 is a top plane view of a blank for forming the cap of the present invention.
Figure 4:
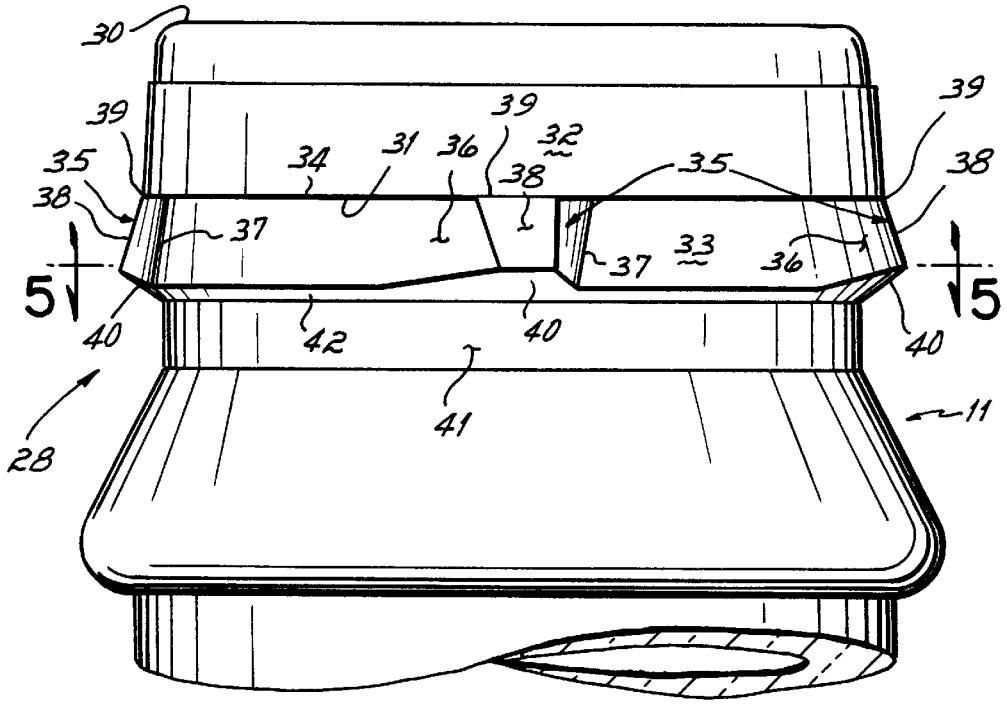
FIG. 4 is a side elevational view of the neck of a bottle of the present invention.
Figure 5:
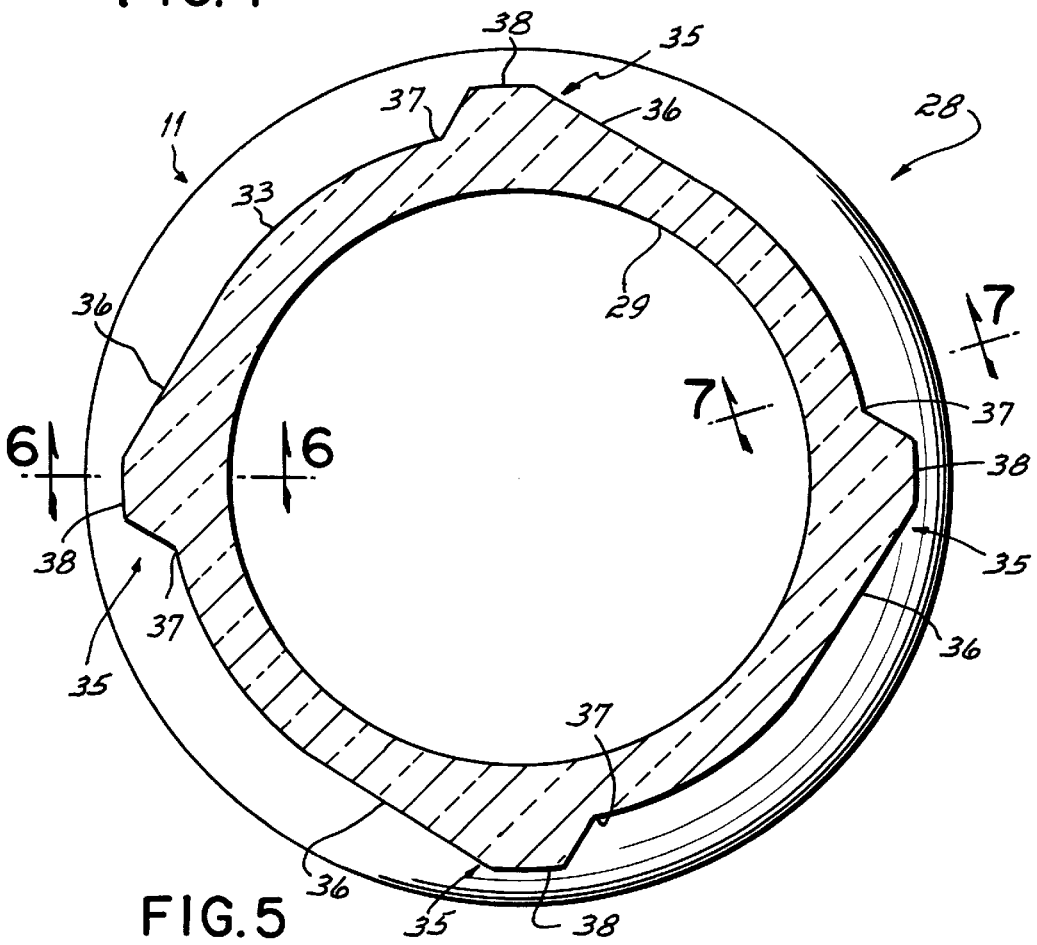
FIG. 5 is a cross-sectional view of the neck of a bottle for use with the present closure system taken along lines 5—5 of FIG. 4.
Figure 8:
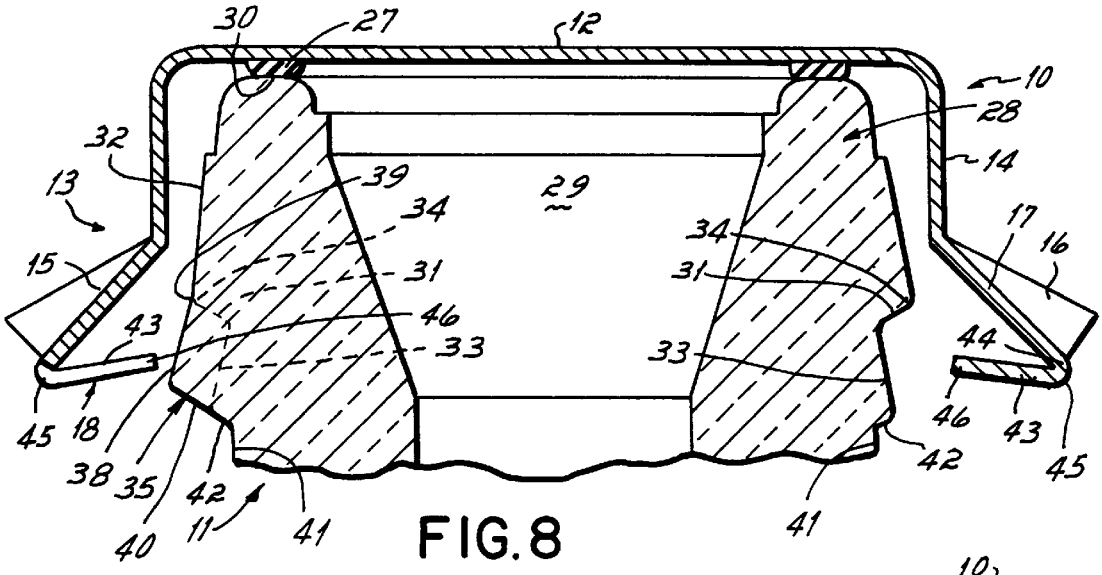
FIG. 8 is a vertical cross-sectional view through the bottle neck and cap similar to FIG. 6, showing a preformed cap as it is initially brought into contact with the sealing rim of the bottle.

Cap 10 is formed from a blank 23 illustrated in FIG. 2. Blank 23 is preferably formed of a suitable metal such as thin steel or aluminum. It includes a generally circular portion 24 which forms the top wall 12 of the cap. Circular portion 24 is surrounded by an annular portion 25 which forms vertical wall 14, ribs 16 and web 17 when the cap is preformed into the shape shown in FIG. 1. It is to be understood that when the cap is formed into the shape shown in FIG. 1, the annular portion 25 is bent downwardly along circular line 26. During this forming operation, ribs 16 are formed intermediate tabs 18 and the lower portion of the skirt remains flared outwardly. Tabs 18 are bent inwardly as shown in FIG. 8 so that the tabs thus form an acute angle with the web portions 17. As shown in FIG. 8, an annular liner, or sealing gasket 27, is adhesively secured to the under surface of top wall 12 of the cap. This liner is adapted to be compressed between the top wall 12 of the cap and the annular sealing rim 30 formed on the outer end of the bottle neck.

Figure 6:
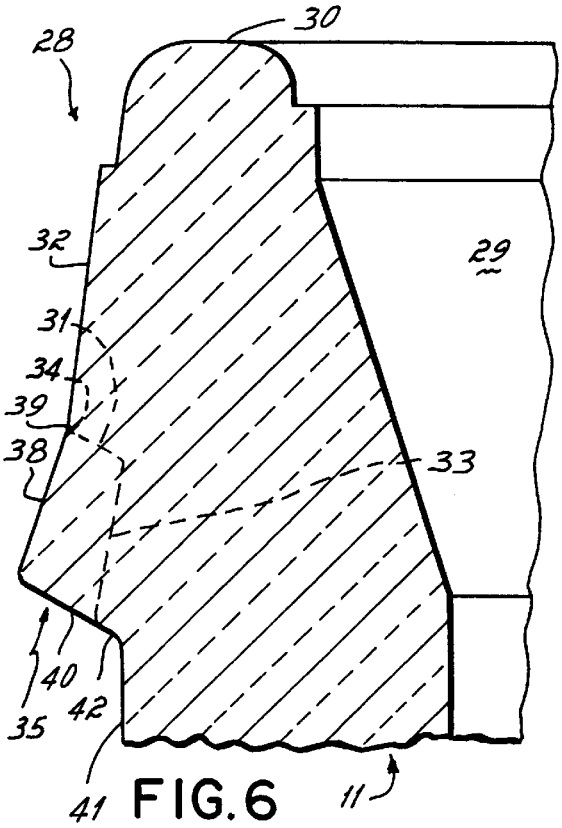
FIG. 6 is a cross-sectional view taken along line 6—6 of FIG. 5.

The second component of the closure system is bottle 11 having a neck portion 28. Neck portion 28 surrounds a central pouring opening 29. Neck 28 terminates in an annular sealing rim 30 which surrounds the pouring opening 29. The outer periphery of the neck is configured to form a ledge 31. Ledge 31 extends inwardly from a generally vertical peripheral wall 32 of an enlarged portion of the neck to a smaller diameter tapered wall portion 33 of the neck. Ledge 31 preferably slopes downwardly and inwardly from peripheral wall 32 at an angle of less than 10° to horizontal. The outermost edge of the ledge joins wall 32 at a rounded junction 34. It will be appreciated that ledge 31 slopes upwardly and outwardly with respect to wall portion 33. A plurality of cams 35, preferably four in number, are formed about the periphery of the neck below ledge 31. Each of the cams includes a generally vertical working surface 36 which extends from an area 37 adjacent to the inner diameter of the ledge 31 to a maximum diameter flat portion 38 spaced radially outwardly beyond the maximum diameter of the ledge in an amount greater than the thickness of tab 18. As shown in FIG. 6, the outermost surface 38 of each of the cams slopes inwardly and upwardly to an area 39 where it merges with wall 32. The lower surface 40 of the cam slopes downwardly and inwardly in the preferred embodiment at an angle of about 30° to horizontal until it merges with cylindrical wall 41 of the neck.

Figure 7:
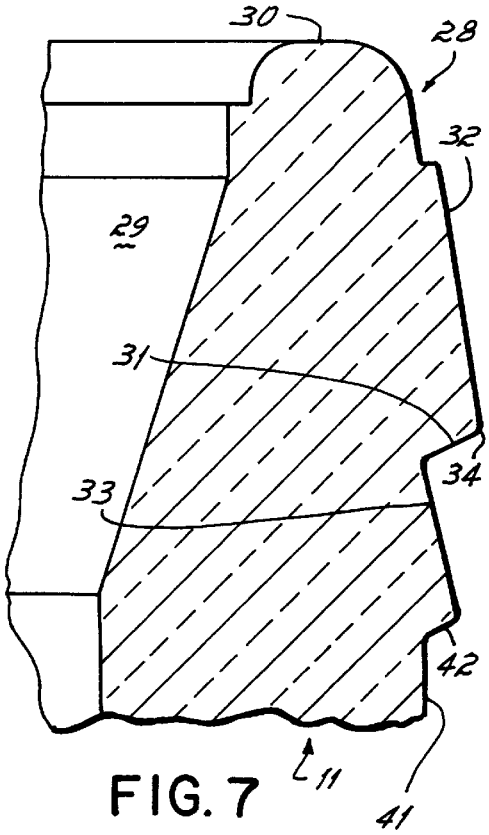
FIG. 7 is a cross-sectional view taken along line 7—7 of FIG. 5.

As shown in FIG. 7, bottle 11 also includes a lower ledge 42 located a short distance, for example 0.090 inch below primary ledge 31. Lower ledge 42 is interconnected by tapered wall 33 with primary ledge 31. Wall 33 slopes upwardly and inward at an angle of the order of 10° to the vertical and is disposed to engage the free transverse edge of the tabs 18 when the tabs are forced inwardly during the capping process.

In use, the bottler is provided with a plurality of bottles 11 and plurality of preformed caps 10 configured as shown in FIG. 1. A cap 10 is placed over the open end of neck 28 of the bottle with a gasket 27 being in engagement with the sealing rim 30 at the end of the neck. A generally conventional capping machine of a type well known to those skilled in the art for applying crown type closures can be used for applying the present cap. Such machines incorporate an annular plunger which can be shifted vertically downwardly to fit over the cap and engage the depending skirt or flange 13. The capping machine compresses gasket 27 and reduces the flare at skirt 13 forming it inwardly from the position shown in FIG. 8 to the position shown in FIG. 9 by reducing the flare diameter. The closing machine also presses tabs 18 inwardly from their position shown in FIG. 8 to their locking position shown in FIG. 9. The tabs are guided in this movement by contact of the transverse edge 22 of the tab with sloping wall 33. When the tabs 18 are forced inwardly, the transverse edges 22 of most of the tabs are brought into engagement with ledge 31. It is to be understood that the present cap is completely locked to the bottle and is effective to provide a pressure resistant seal across pouring opening 29 even though not all of the tabs are locked against ledge 31. It is also to be understood that when the tabs are in the locked position shown in FIG. 9, the upwardly bent wall sections 43 of the tabs are placed in compression while the outer portion 44 of the tab wall 46 beyond the "V" shaped bend 45 are placed in tension. This causes a downward force to be exerted on the cap causing the top wall 12 to hold the gasket 27 in compression against the sealing rim 30 of the bottle neck to seal the bottle. Tabs 18 are dimensioned so that they do not buckle when they are in the locking position shown in FIG. 9 and a maximum design pressure is present within the bottle. However, if the pressure within the bottle substantially exceeds the design pressure, the tabs bow slightly while remaining in engagement with lip 31. This permits the cap to rise slightly providing a clearance between gasket 27 and the sealing surface on the neck of the bottle. As a result, pressurized gas can escape from the bottle without causing the cap to blow off the end of the bottle.

I have determined that the optimum cooperative engagement between tabs 18 and ledge 31 is attained if the tabs engage the ledge at substantially right angles, preferably 90° or less. I have determined that this angle of contact is obtained if the angle Y which the ledge makes with horizontal is kept below 10° (as shown in FIG. 8). The angle X which tabs 18 make with a vertical line is kept above 10° so that the angle W between the ledge and tabs is kept 90° or less.

Figure 9:
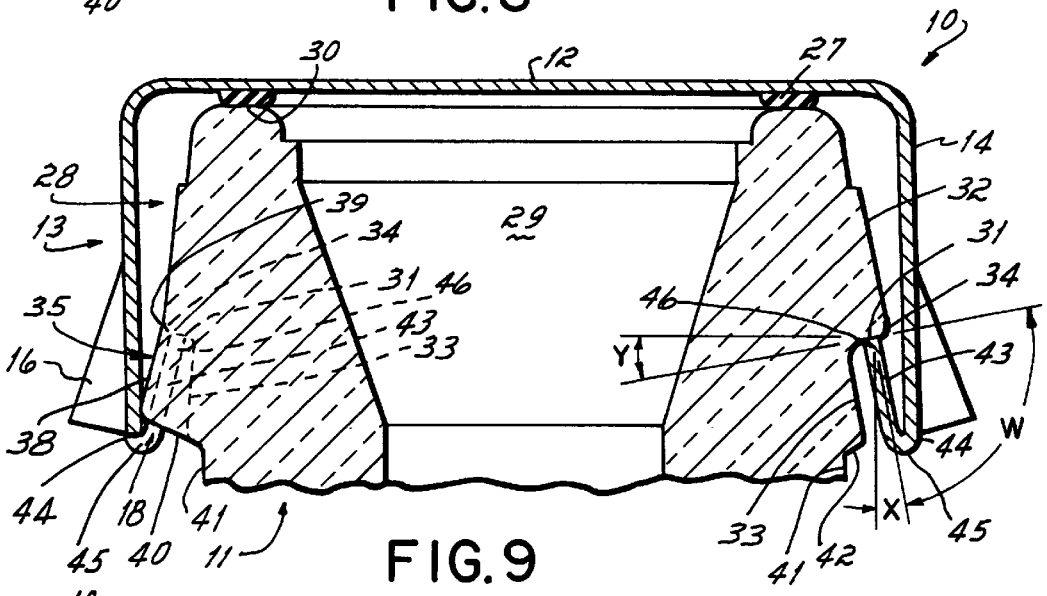
FIG. 9 is a vertical cross-sectional view similar to FIG. 8 showing the tabs of the cap in a position in which they have been forced inwardly against the under surface of the ledge so that the cap is sealed and locked onto the bottle.

When the cap 10 is to be removed by a user, the cap is rotated counter-clockwise approximately 90° by hand. As the cap is rotated, tabs 18 are cammed outwardly by the vertical working walls 36 of the cams 35. The tabs are bent to the position shown in FIG. 10 in which the inner tab sections 43 are brought closely adjacent to and substantially parallel with the outer wall sections and webs 17. It is to be noted that webs 17 are also bent slightly outwardly. As a result, a substantial horizontal clearance is created between the innermost surfaces 46 of tabs 18 and the maximum diameter 34 of ledge 31. As shown in FIG. 9, the outermost flat surfaces 38 of cams 35 are disposed at a greater distance from the center line of the bottle neck than the maximum diameter of ledge 31 or any other portion of the bottle disposed between the surface 38 and the sealing rim 30 of the pouring opening. Consequently, when the cap 10 has been rotated 90°, it is retained on the bottle only by the engagement of four tabs with the four cams 35. It is apparent to the user that the cap has been loosened and can readily be removed by simply lifting it. There is no appreciable resistance to the final upward removal of the cap.

Figure 10:
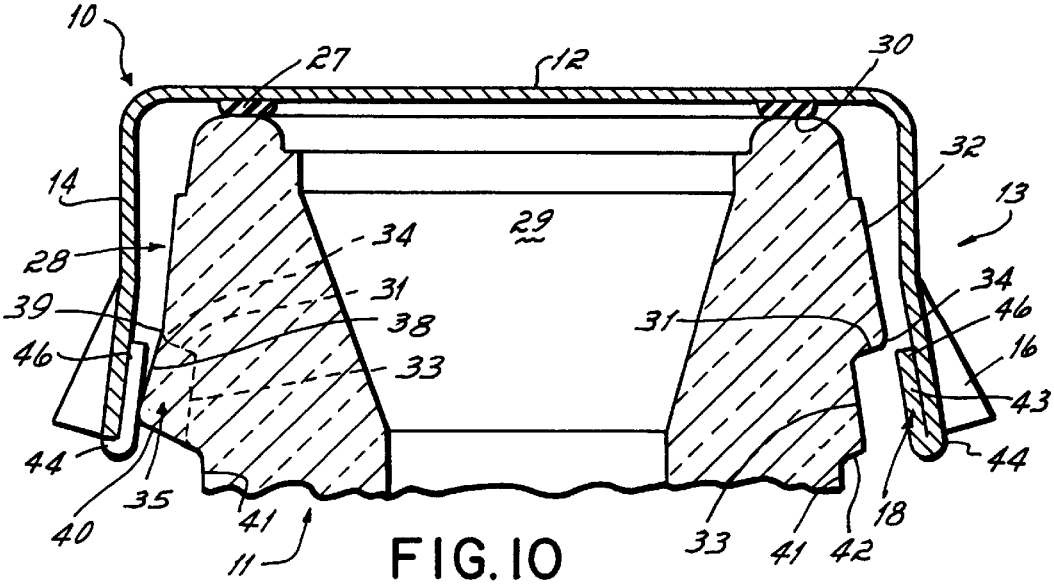
FIG. 10 is a vertical cross-sectional view of the cap and bottle similar to FIG. 8, showing the cap after it has been twisted during removal to force the tabs outwardly from contact with the ledge.

After the cap 10 has been removed, sections 43 of the tabs remain bent upwardly in substantially the same position shown in FIG. 10. It is impossible to reapply cap 10 to the bottle and to reset the tabs in a locking engagement with the ledges as shown in FIG. 9 except by returning the cap to the state shown in FIG. 8 and utilizing expensive and complicated machinery. Consequently, as a practical matter, the most that can be done with the cap is to place it back over the end of the bottle in the position shown in FIG. 10. In that position, the cap is very loose and the tabs are bent against the skirt, giving clear visual warning that the cap has previously been removed. A cap repositioned in this manner cannot hold liquid in a bottle when inverted. It will of course be obvious that no amount of rotation of the cap in either direction will cause the tabs 18 to bend into the locking position shown in FIG. 9. As a result, the present cap provides a highly visible warning that the container has been tampered with by previous removal of the cap. The tamper proof aspect of the cap is highly reliable since there is no practical way in which the cap can be replaced upon the bottle.

From the foregoing disclosure of the general principles of the present invention and the above description of a preferred embodiment, those skilled in the art will readily comprehend various modifications to which the invention is susceptible. Therefore, I desire to be limited only by the scope of the following claims.

The invention claimed is:

1. A tamper-proof closure system comprising:

a container having a neck;

said neck comprising a first wall portion and a central pouring opening;

a sealing rim formed on said neck surrounding said central pouring opening;

a downwardly facing annular ledge projecting outwardly from said first wall portion of said neck, said ledge having an inner diameter and an outer diameter;

a plurality of cams spaced peripherally about said neck and having portions disposed below said ledge;

each of said cams providing a working surface extending from the inner diameter of said ledge, around said neck, to a projecting portion disposed outwardly beyond the outer diameter of said ledge;

said projecting portion of each of said cams being disposed radially outwardly of said ledge and radially outwardly of all portions of said neck intermediate said cam and said sealing rim; and a tamper-proof cap comprising a top wall, a depending peripheral flange, said flange being configured to form a plurality of vertical ribs and a plurality of webs interconnecting said ribs, tabs extending from said webs, each of said tabs having a first side edge, a second side edge and a transverse edge interconnecting said side edges, said tabs being bent inwardly and being dimensioned to engage said ledge to maintain a downward sealing force on said top wall.

2. The tamper-proof closure system of claim 1 in which said ledge slopes axially upwardly and radially outwardly.

3. The tamper-proof closure system of claim 1 in which the outer edge of said ledge joins a second wall portion at a junction.

4. The tamper-proof closure system of claim 3 in which said junction is rounded.

5. The tamper-proof closure system of claim 3 in which said second wall portion tapers upwardly and inwardly toward said sealing surface.

6. The tamper-proof closure of claim 1 in which said cam includes a bottom wall and said working surface extends upwardly from said bottom wall to said second wall portion.

7. The tamper-proof closure system of claim 6 in which said working surface slopes upwardly and inwardly.

8. The tamper-proof closure system of claim 1 further comprising a second ledge spaced from and disposed beneath said downwardly facing annular ledge.

9. A tamper-proof closure system of claim 8 further comprising an upwardly and inwardly extending wall interconnecting said second ledge and the inner diameter of said downwardly facing annular ledge.

10. The tamper-proof closure system of claim 1 in which said tabs engage said ledge at substantially right angles.

11. The tamper-proof closure system of claim 1 in which said cams are dimensioned to bend said tabs substantially parallel to said skirt when said cap is rotated.

12. The tamper-proof closure system of claim 1 in which said cams are dimensioned to bend said skirt outwardly when said cap is rotated.

13. A container for use in a tamper-proof closure system, said container comprising:

a neck;

said neck comprising a first wall portion and a central pouring opening;

a sealing rim formed on said neck surrounding said central pouring opening;

a downwardly facing annular ledge projecting outwardly from said first wall portion of said neck, said ledge having an inner diameter and an outer diameter;

a plurality of cams spaced peripherally about said neck and having portions disposed below said ledge;

each of said cams comprising a working surface extending from the inner diameter of said ledge around a segment of said neck to a projecting portion disposed outwardly beyond the outer diameter of said ledge;

said projecting portion of each said cam being disposed radially outwardly of said ledge and radially outwardly of all portions of said neck intermediate said cam and said sealing rim.

14. The container of claim 13 in which said ledge slopes axially upwardly and radially outwardly.

15. The container of claim 13 in which the outer edge of said ledge joins a second wall portion at a junction.

16. The container of claim 15 in which said junction is rounded.

17. The container of claim 15 in which said second wall portion tapers upwardly and inwardly toward said sealing surface.

18. The container of claim 13 in which said cam includes a bottom wall and said working surface extends upwardly from said bottom wall to said second wall portion.

19. The container of claim 18 in which said working surface slopes upwardly and inwardly.

20. The container of claim 13 further comprising a second ledge spaced from and disposed beneath said downwardly facing annular ledge.

21. The container of claim 13 further comprising an upwardly and inwardly extending wall interconnecting said second ledge and the inner diameter of said downwardly facing annular ledge.

22. A tamper-proof closure system comprising:

a container having a neck including a central pouring opening;

a sealing rim on said neck surrounding said central pouring opening;

a tamper-proof, cup-shaped cap having a sealing surface therein for engaging said sealing rim to seal said pouring opening and a periphery;

a plurality of tabs extending from said periphery and bent inwardly toward said neck when the cap is disposed on said pouring opening;

said neck including a ledge extending outwardly therefrom and facing away from said sealing rim to receive said tabs in locking position against removal from said container;

said neck including a plurality of cams spaced there around for opening said tabs outwardly with respect to said neck when said cap is twisted to remove said cap from said neck;

said cams projecting outwardly from said neck to a position outwardly beyond said ledge and any portion of said neck between said cams and said sealing rim.

23. A tamper-proof closure system comprising:

a container having a neck defining a pouring opening;

a sealing rim about said pouring opening;

a ledge extending outwardly around said neck facing away from said sealing rim;

a tamper-proof cap for sealing on said sealing rim and a plurality of locking tabs extending from a periphery of said cap and bent inwardly, said tabs having ends engaging said ledge when said cap is installed on said container; and a plurality of cams having projections for moving said tab ends away from said ledge when said cap is twisted to remove it from said container, said cams extending radially outwardly of said ledge and any neck structure between said ledge and said sealing rim so that twisting said cap urges said tabs and said tab ends outwardly and away from any neck structures interfering with subsequent removal of said cap from said container.

24. A container for use in a tamper-proof closure system which includes a twist-off cap having a plurality of locking tabs for engaging a ledge on said container to hold said cap operably on said container and for releasing said cap from said container when moved radially outward of said ledge, said container comprising:

a neck including a pouring opening, defined by a rim at one end of said container, a ledge around said neck defining an abutment surface for locking tabs of a cap; and at least one cam operably disposed in conjunction with said ledge for urging locking tabs of a cap outwardly from said ledge when a locking cap is twisted about said neck, said cam having a surface projecting radially outwardly of said ledge and outwardly of all portions of said neck between said ledge and said rim.

25. A container for use with a cap having a plurality of locking tabs for holding said cap on a neck end of said container, said container comprising:

a neck at one end of said container, said neck having a pouring opening defined by a rim at the end of said container, a ledge proximate said rim for holding cooperation with locking tabs of a cap; and at least one cam surface in operative communication with said ledge for urging locking tabs of a cap radially outwardly from said ledge when the cap is twisted for removal from said neck, said cam surface including a cam projection extending radially outwardly of said ledge and radially outwardly of all portions of said neck intermediated said ledge and said rim.

* * * * *